United States Patent [19]

Strauss

[11] Patent Number: 4,495,114

[45] Date of Patent: Jan. 22, 1985

[54] LEAF SPRING DIFFUSER WITH AMPLITUDE LIMIT

[76] Inventor: Walter C. Strauss, 718 E. Freistadt, Thiensville, Wis. 53092

[21] Appl. No.: 571,431

[22] Filed: Jan. 17, 1984

[51] Int. Cl.[3] ..... B01F 3/04

[52] U.S. Cl. ..... 261/81; 137/856; 210/220; 261/122; 261/124

[58] Field of Search ..... 137/856, 857; 261/124, 261/122, 81; 210/220

[56] References Cited

U.S. PATENT DOCUMENTS

| | | | |
|---|---|---|---|
| 1,083,789 | 1/1914 | Alexanderson | 137/856 |
| 1,456,444 | 5/1923 | Holick | 137/857 |
| 1,480,608 | 1/1924 | Gardner | 137/856 |
| 1,494,176 | 5/1924 | Little | 137/856 |
| 2,118,356 | 5/1938 | Money | 137/857 |
| 2,332,992 | 10/1943 | Davis | 137/857 |
| 2,415,048 | 1/1947 | Sharp | 210/220 |
| 2,926,692 | 3/1960 | Zillman | 137/856 |
| 3,722,836 | 3/1973 | Savage | 261/124 |
| 3,754,740 | 8/1973 | Piper | 261/124 |
| 4,218,407 | 8/1980 | Robertson | 137/857 |

FOREIGN PATENT DOCUMENTS

| | | | |
|---|---|---|---|
| 563086 | 7/1944 | United Kingdom | 137/856 |

*Primary Examiner*—Ernest G. Therkorn
*Attorney, Agent, or Firm*—A. G. Douvas

[57] ABSTRACT

A leaf spring diffuser for use in an aeration tank of a water treatment system. An amplitude-limiting stop is mounted on each vibrating extremity of the diffuser leaf spring to project into the diffuser air chamber. Each stop engages the diffuser body to prevent the leaf spring from being subjected to an excess bending moment which would otherwise deform the leaf spring and promote clogging of the diffuser parts.

3 Claims, 8 Drawing Figures

LEAF SPRING DIFFUSER WITH AMPLITUDE LIMIT

BACKGROUND OF THE INVENTION

1. Field of the Invention

This invention relates to air diffusers employed in waste water treatment plants, and in particular to an amplitude controlling stop for limiting the opening movements of a leaf spring used to modulate the air outlet ports of such diffusers.

2. Description of the Prior Art

Air diffusion systems employed in sewage treatment aeration tanks generally comprise a plurality of air diffusers supplied by air from headers. These headers are usually disposed in a horizontal position and they are formed with rows of connections to which air diffusers of various designs may be attached.

In recent years, diffusers employing resilient leaf springs which modulate the air from the discharge port openings of the diffuser have found extensive commercial acceptance. The leaf spring designs employed in the prior art are susceptible to easy clogging of the port openings so that reliable diffusion of air in optimum amounts and at all diffuser locations is not attainable. Such clogging is often due to fibrous material becoming lodged between the diffuser body and the leaf spring.

In order to get an adequate amount of air into the aeration tank when clogging occurs, the air pressure is often increased to the point that the leaf springs are forced beyond their elastic limit, resulting in a permanent deformation of the leaf spring. This deformation prevents the leaf spring from completely closing off the diffuser ports. Consequently, sewage water and its sludge clogging contents backup into the diffuser chambers.

As a result of this tendency to deform the leaf springs, the design of leaf spring diffusers has been less than optimum in that the leaf spring bodies are made of materials displaying less resilience than is desirable. The size of the attachment means to the leaf springs body is also excessive. Additionally, because of the restraints on the design and the size of the leaf spring including its attachment to the diffuser body, it is not possible in many instances to design the discharge ports in the diffuser body to deliver minimum pressure drop at the required rates of air delivery to the sewage treatment tank.

U.S. Pat. No. 2,415,048 discloses an air diffuser which employs means for restricting the deflection of a resilient plate. The limiting means shown in that patent is susceptible to excessive clogging and therefore does not disclose a practical solution to the problem of leaf spring deformation.

SUMMARY OF THE INVENTION

Accordingly, a principal object of this invention is to provide an effective control which will insure that a leaf spring employed in an air diffuser will not receive a bending moment that exceeds its elastic limit.

Another object of the invention is the attainment of an improved leaf-spring air diffuser which is essentially self-cleaning, thereby substantially reducing the frequency at which a system must be shut down for system adjustments to compensate for clogged outlet ports.

A further object of this invention is to provide an amplitude limiting control for such a leaf spring which will enable a relatively thinner spring to be used for shallow applications in aeration tanks and a heavier spring for deeper applications. This spring design will enable the spring to operate at a higher overall oscillating frequency thereby resulting in more efficient aeration.

A principal structural feature of this invention is the provision of an amplitude limiting stop control on the vibrating extremities of each leaf spring. This stop is disposed inwardly toward the diffuser air chamber so as to be isolated when the leaf spring closes off its port. When the leaf spring is flexed by the release of air, the continuous vibration of the amplitude limiting stop, together with air screen formed by the outward flow of air around the shank of the pin prevents the accumulation of fibrous and other clogging materials at the stop.

In the event of excessive air pressure, undue bending of the leaf spring is prevented by the engagement of the amplitude limiting stop with the diffuser body so that movement of the leaf spring beyond its elastic limit is prevented.

DETAILED DESCRIPTION OF THE DRAWINGS

In order that all of the structural features for attaining the objects of this invention may be readily understood, reference is made to the drawings in which.

DETAILED DESCRIPTION OF THE PREFERRED EMBODIMENTS

Figure 1:
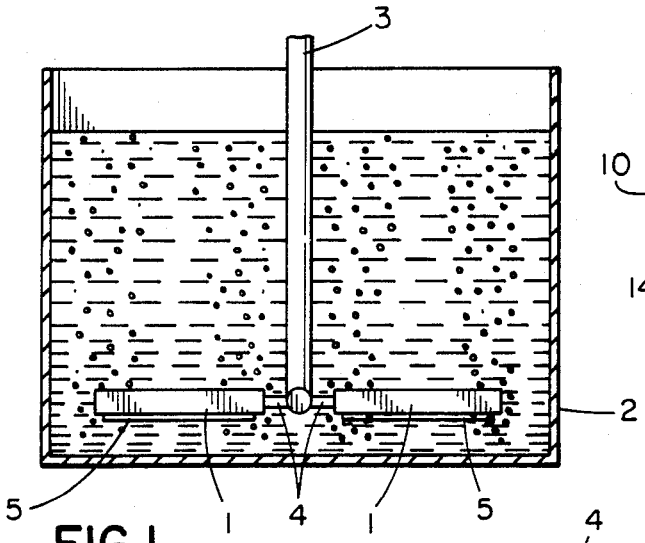
FIG. 1 is a schematic view, partly in section, showing a sewage treatment tank with a pair of diffusers embodying the invention.
Figure 2:
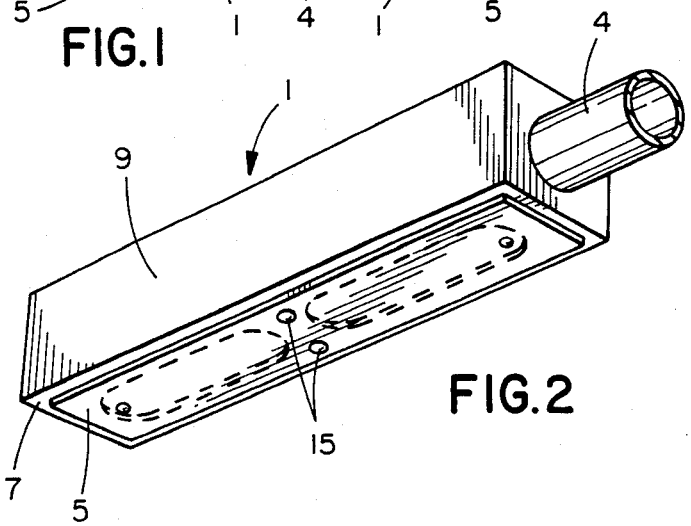
FIG. 2 is a perspective view of a single diffuser of the invention.
Figure 3:
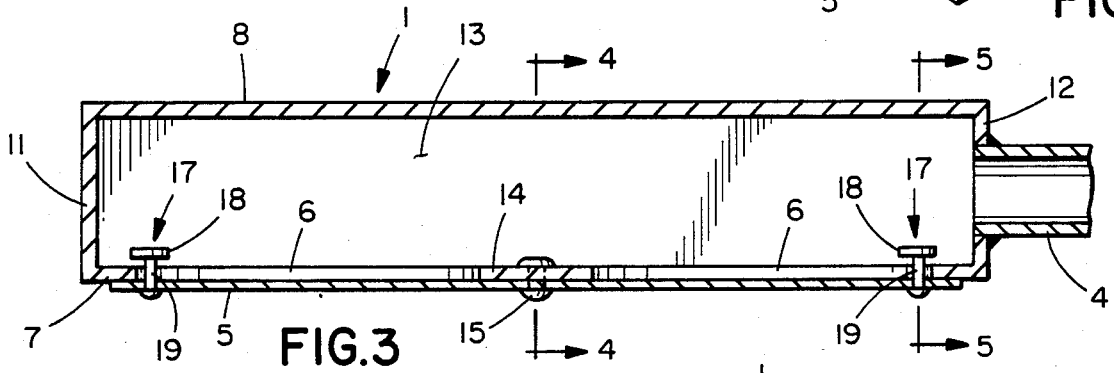
FIG. 3 is a longitudinal section view of the diffuser of FIG. 2 showing a pair of inwardly projecting stop pins mounted on the diffuser leaf spring.

Referring to the drawings, a pair of air diffusers 1 are installed within sewage treatment tank 2 (FIG. 1) in order to aerate the tank. Air is supplied to diffusers 1 through air inlet pipe 3 and connectors 4. Each of diffusers 1 is formed with a rectangular, resilient leaf spring 5 which closes off a pair of elongated air outlet ports 6 (FIG. 2) formed in bottom wall 7 of diffuser 1 (FIG. 3). Bottom wall 7, top wall 8, side walls 9 and 10, and end walls 11 and 12 form an elongated generally rectangular body whose interior defines air chamber 13. The components of diffuser 1 are preferably fabricated of stainless steel or of a corrosion free material in waste water applications.

Figure 4:
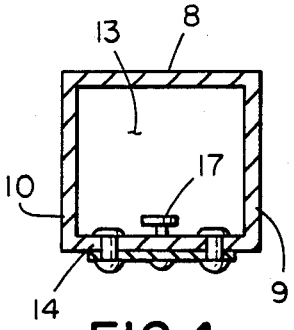
FIG. 4 is a section view taken along line 4—4 of FIG. 3 showing the center rivets which attach the leaf spring to the diffuser body.
Figure 5:
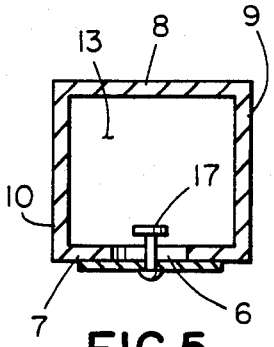
FIG. 5 is a section view taken along line 5—5 of FIG. 3 showing the position of a stop pin when the diffuser ports are closed by the leaf spring.
Figure 6:
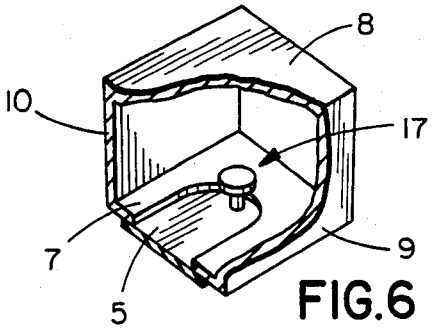
FIG. 6 is a fragmentary perspective view showing the shape of the stop of FIG. 5.

Bottom wall 7 is formed with a leaf-spring support section 14 disposed between the pair of air outlet ports 6 (FIGS. 4 and 7) which extends between side walls 9 and 10. The central portion of leaf spring 5 is fastened to support section 14 by a fastener rivet 15. The extremities of leaf spring 5 are free to move downwardly relative the diffuser body, as shown by arrows 16 in FIG. 7. With this leaf spring motion, air outlet ports 6 are uncovered and air supplied to cavity 13 by connector 4 is released into sewage treatment tank 2.

As is taught in the prior art, the motion of leaf spring 5 is actually a relatively high-frequency vibration which modulates the air output of ports 6 to release a stream of air bubbles into tank 2. The oscillation of leaf spring 5 shears the air as it exits from the ports to small bubbles, which optimizes efficiency.

Diffuser 1 of this invention incorporates a novel amplitude-limit stop 17 (FIGS. 3–7) at each extremity of leaf spring 5. Each stop 17 insures that the spring will not receive a bending moment that exceeds its elastic limit. Bending beyond the elastic limit will, of course, leave port 6 continuously open so that the proper generation of air bubbles will cease. This problem of excess bending is particularly prevalent with prior art diffusers employing elongated leaf springs during those occurrences when the air supply to the diffuser is interrupted due to power failure. At these times, water seeps into the aeration piping; and when the system is started up, the combination of air and water into the piping sets up a water hammer effect for a very short period of time. The water hammer effect produces a moment on the leaf spring that exceeds its elastic limit.

U.S. Pat. No. 2,415,048 discloses an exposed screw that projects outwardly from a diffuser body for limiting the deflection of a resilient plate which closes off a series of small diffuser outlet ports located on a base plate. The screw is mounted on the base plate so as to pass through a slot in the resilient plate. The screw is also formed with an enlarged head. This construction is not effective because fibrous or other solid material can lodge between the two plates and wrap around the shank of the motionless screw to hold the deflecting plate open. In other instances, the same materials can engage the head of the screw and hold the deflecting plate closed or partially closed.

With amplitude-limit stop 17 being positioned on the inside of the diffuser body spring and because the spring and limit stop are in constant motion, the pin cannot become entangled with fibrous material commonplace within sewage treatment tanks.

Figure 8:
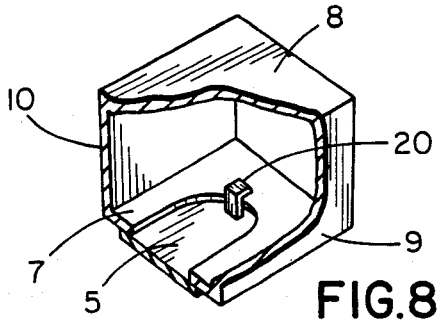
FIG. 8 is a fragmentary perspective view, related to FIG. 6, which shows a second preferred embodiment of the stop.
Figure 7:
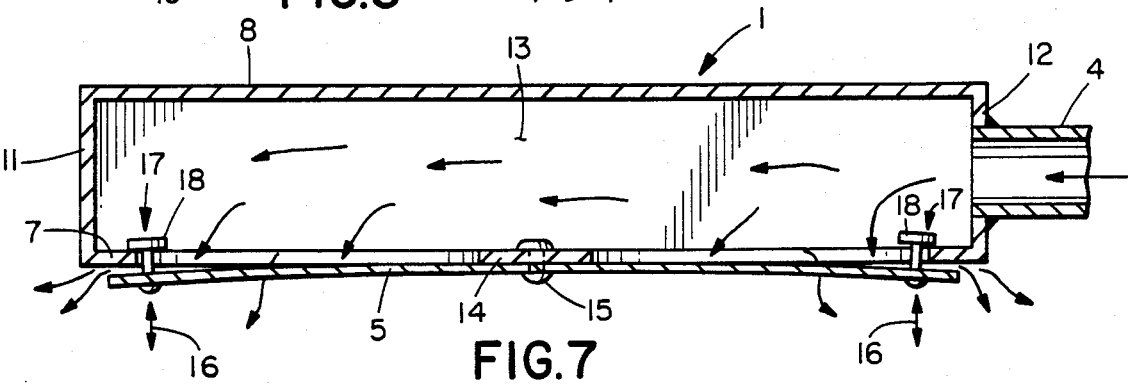
FIG. 7 is a longitudinal section view related to FIG. 3 showing both stops limiting the opening movement of the leaf spring in response to the discharge of air through the diffuser ports.

A first preferred embodiment for amplitude limiting stop 17 is shown in FIGS. 3 through 7. Stop 17 comprises a circular disk-like head 18 supported on pin shaft 19 (FIG. 3). As is shown in FIG. 7, the projecting periphery of each disk 18 engages the adjacent portion of bottom wall 7 when the extremities of leaf spring 5 are subjected to maximum bending due to the flow of air through air chamber 13 of diffuser 1. This outward flow of air around each vibrating pin shaft 19 is extremely effective in preventing fibrous material from entangling engagement with each stop 17. An L-shaped design for amplitude-limit stop 20 is shown in FIG. 8. This second preferred embodiment further minimizes the possibility of entanglement with fibrous material. The L-shape of stop 20 further insures that fibrous material will slip off the stop.

The most important function of a diffuser is to produce the maximum amount of oxygen with a minimum amount of power. With the limit-controlled leaf spring design of this invention, diffuser 1 can be designed with a proper leaf spring 5 to operate at an optimum frequency resulting in very small bubbles and a high operational efficiency. In prior diffuser designs employing leaf spring, a main design criterion was for a strong leaf spring, so that the spring would not exceed its elastic limit under any conditions.

The improved limit-controlled leaf spring 5 of this invention closes against discharge ports 6 of the diffuser, when the air is shut off. This keeps particulate matter from backing up into the aeration system which could cause clogging. In the prior art, if the leaf spring had a slight deformity due to excess bending, it would not seal properly and sludge would build up in the diffuser.

The limit-controlled leaf spring 5, also acts as a variable orifice. When the air rate is changed, the leaf spring opens or closes, depending on the air volume delivered to the system. This develops a linear pressure drop, which means that the actual pressure does not change much over varying air flow rates. Other types of diffuser devices have a fixed orifice to develop a controlled pressure drop, but when the air rate is changed, the pressure drop is a square root function, which can cause very high back pressure.

Limit-controlled leaf spring 5 is a self-cleaning device, because the leaf spring and its stop 17 or 20 are constantly vibrating on the diffuser body, with a high pressure stream of air between the two surfaces. Any impurities that find their way into the diffuser from the liquid side, or air side, are flushed from the contact surfaces.

Diffuser 1 is also preferably installed with discharge ports 6 down, therefore, air cannot be released from the diffuser until all liquid is displaced from the diffuser air chamber 13. Many diffusers have discharge ports on the top or on the side, thus they do not drain, and can cause plugging.

Because the amplitude of leaf spring 5 is controlled, thinner springs can be used for all applications thus developing a higher oscillating frequency and better operation. A relatively thinner spring is used for shallow applications, and a heavier spring for deeper applications With an amplitude limiting stop on a leaf spring, the spring can be engineered with a wide range of sizes. In prior art designs, the range of leaf spring sizes is restricted because large surface areas would be subjected to excessive bending moments.

With a control on the travel of a leaf spring, the actual discharge port in the diffuser body can be designed to deliver minimum pressure drop at design air rates. In the prior art this discharge opening is kept smaller than necessary, so that if a leaf spring did deform, there would be a built in pressure drop and not all the air would come out the one port.

The improved leaf spring design of this invention requires much smaller fastening means and a reduced mounting surface area. With prior art designs, the mounting surface area is relatively large because it is the only surface that holds the leaf spring against the diffuser body, and it has to give enough support to contain the spring under all bending moments.

A diffuser system employing the diffuser design of this invention operates at a high efficiency year after year without equipment shutdowns necessary to effect repeated cleaning of the diffusers.

It should be understood that the above described embodiments are merely illustrative of the principles of this invention, and that modification can be made without departing from the scope of the invention.

What is claimed is:

1. In an air diffuser for the treatment of sewage having a diffuser body defining an internal air chamber which is supplied by air through an air inlet and which delivers the air to a sewage tank through an air outlet port formed in the body, and from which port air flow is periodically modulated by a resilient vibrating leaf spring affixed to the exterior of the body, the improvement for limiting the amplitude of the outward deflection of the leaf spring into the sewage tank comprising a leaf-spring amplitude-limiting stop fixedly mounted on an extremity of the leaf spring subject to maximum deflection to move therewith with the stop being directed inwardly to pass through the port and into the internal air chamber, the stop having a cross-sectional area in a plane generally normal to its direction of motion substantially less than the area of the port opening so that the stop does not obstruct the flow of air out the port, and with the stop being formed with a portion located within the internal air chamber and engaging the diffuser body when the extremity of the leaf spring is deflected outwardly and away from the diffuser body to limit thereby the amplitude of leaf spring deflection.

2. The combination of claim 1 in which the stop comprises a disk portion supported on a shaft projecting from the leaf spring.

3. The combination of claim 1 in which the stop comprises a generally L-shaped element projecting from the leaf spring.

* * * * *